US005140765A

United States Patent [19]

King

[11] Patent Number: 5,140,765

[45] Date of Patent: * Aug. 25, 1992

[54] SIGN

[75] Inventor: Samuel C. King, Kensington, Australia

[73] Assignee: Signcraft Pty. Limited, Kensington, Australia

[ * ] Notice: The portion of the term of this patent subsequent to Aug. 27, 2008 has been disclaimed.

[21] Appl. No.: 672,428

[22] Filed: Mar. 20, 1991

Related U.S. Application Data

[63] Continuation of Ser. No. 211,292, Jun. 24, 1988, Pat. No. 5,042,182.

[30] Foreign Application Priority Data

| | | | |
|---|---|---|---|
| Jun. 25, 1987 | [AU] | Australia | PI2692/87 |
| Sep. 11, 1987 | [AU] | Australia | PI4290/87 |
| Mar. 21, 1988 | [AU] | Australia | PI7348/88 |

[51] Int. Cl.[5] ..... G09F 17/00

[52] U.S. Cl. ..... 40/603; 40/574

[58] Field of Search ..... 40/603, 574, 572, 549; 160/378, 387

[56] References Cited

U.S. PATENT DOCUMENTS

| | | | |
|---|---|---|---|
| 1,782,905 | 11/1930 | Mohun et al. | 160/387 |
| 3,978,905 | 5/1976 | deLama et al. | 160/378 |
| 4,317,302 | 3/1982 | Von De Linde | 40/603 |
| 4,542,605 | 9/1985 | Gandy | 40/603 |
| 4,547,987 | 10/1985 | Stilling | 40/603 |
| 4,554,754 | 11/1985 | Stilling | 40/603 |
| 4,674,213 | 6/1987 | Keithley | 40/603 |
| 4,817,317 | 4/1989 | Kovalak, Jr. | 40/603 |

*Primary Examiner*—Cary E. O'Connor
*Attorney, Agent, or Firm*—James Creighton Wray

[57] ABSTRACT

A sign of the flexible face type in which, about the periphery of the sign face there is an extension member which is adapted to be received in and retained in a complementary member which complementary means is adapted to be moveable relative to the members of the sign frame to whereby permit tensioning of the fabric.

6 Claims, 4 Drawing Sheets

SIGN

This application is a continuation of Ser. No. 07/211,292, now U.S. Pat. No. 5,042,182.

This invention relates to an improved sign and, particularly, to a sign of the type where the information of the sign is incorporated on flexible material.

Until relatively recently, where large signs were to be used, particularly signs attached to the face of shopping centres or located on supports adjacent to some area, these signs were quite conventionally made of an acrylic material.

Whilst acrylic signs were, in some ways, fully satisfactory, there were problems, particularly where large signs were required, as there is a physical limit to the size of sheets of acrylic material which are available and, further, there are difficulties in handling very large sheets of this material.

Over the last few years, there has been a movement in signs of this general type, to use a fabric face for the sign, the fabric being of a woven material which presents a relatively smooth surface of a synthetic plastics material and the use of this material has overcome the major disadvantages of acrylic signs in that a sign of any length can be readily manufactured simply by taking material of the required length from a roll and, where it is necessary to make a sign which has a dimension which, for ease, we shall call width, which is wider than the width of the widest roll, it is easy to weld the fabric so as to provide a facing of the required dimensions.

These facings can be treated by well known sign writing methods and, in practice, it has been shown that they are at least as durable as acrylic signs and, in fact, may well be more durable.

One disadvantage signs of this type have is that, to date, the method of fixing the flexible material to the frame of the sign has been very complex and it has normally used complicated extrusions which are expensive.

Further, it has been difficult to correctly locate and tension the sign face and, if a sign was to have material along the edges, it has often been necessary to insert this after the sign is located.

For this reason the signs have not been as popular as they would otherwise have been expected to be.

It is the object of the present invention to provide a sign of this general type, wherein the means of connection is basically simple and cheap and which, at the same time, permits ready access to the interior of the sign, which may often include lighting equipment, for maintenance.

It is a second object to provide a sign which is a direct replacement for an acrylic sign face in the same box as the original sign.

The invention, in its broadest sense, includes a sign of the flexible faced type wherein, at or adjacent the edge of the fabric of the sign, there is provided an extension, complementary means located about the periphery of the sign body and adapted to receive this extension and means whereby this complementary means can be moved relative to the face of the sign to thereby apply tension to the fabric.

It is preferred that the sign has about its periphery a rope or other member sewn into a pocket formed from the sign material and this is adapted to cooperate with an open sided extrusion or the like of substantially complementary shape wherein the edge of the sign is restrained.

Alternatively, a form of extrusion can be connected to the edge of the sign by sewing, welding or adhesive.

The extrusion is adapted to be connected to the body of the sign or something adjacent the body of the sign in such a way that it can be moved relative thereto to provide a tensioning force on the fabric of the sign.

The sign of the invention also provides means whereby full faced signs can readily be arranged and we also provide means for retro fitting the sign of the invention to standard sign boxes and propose a means whereby the whole of the sign assembly of the invention can be incorporated into a conventional sign box so the finished sign has the same dimensions as the original sign.

In order that the invention may be more readily understood and put into practice, we shall describe three specific embodiments of the invention in relation to the accompanying drawings, in which.

Figure 1:
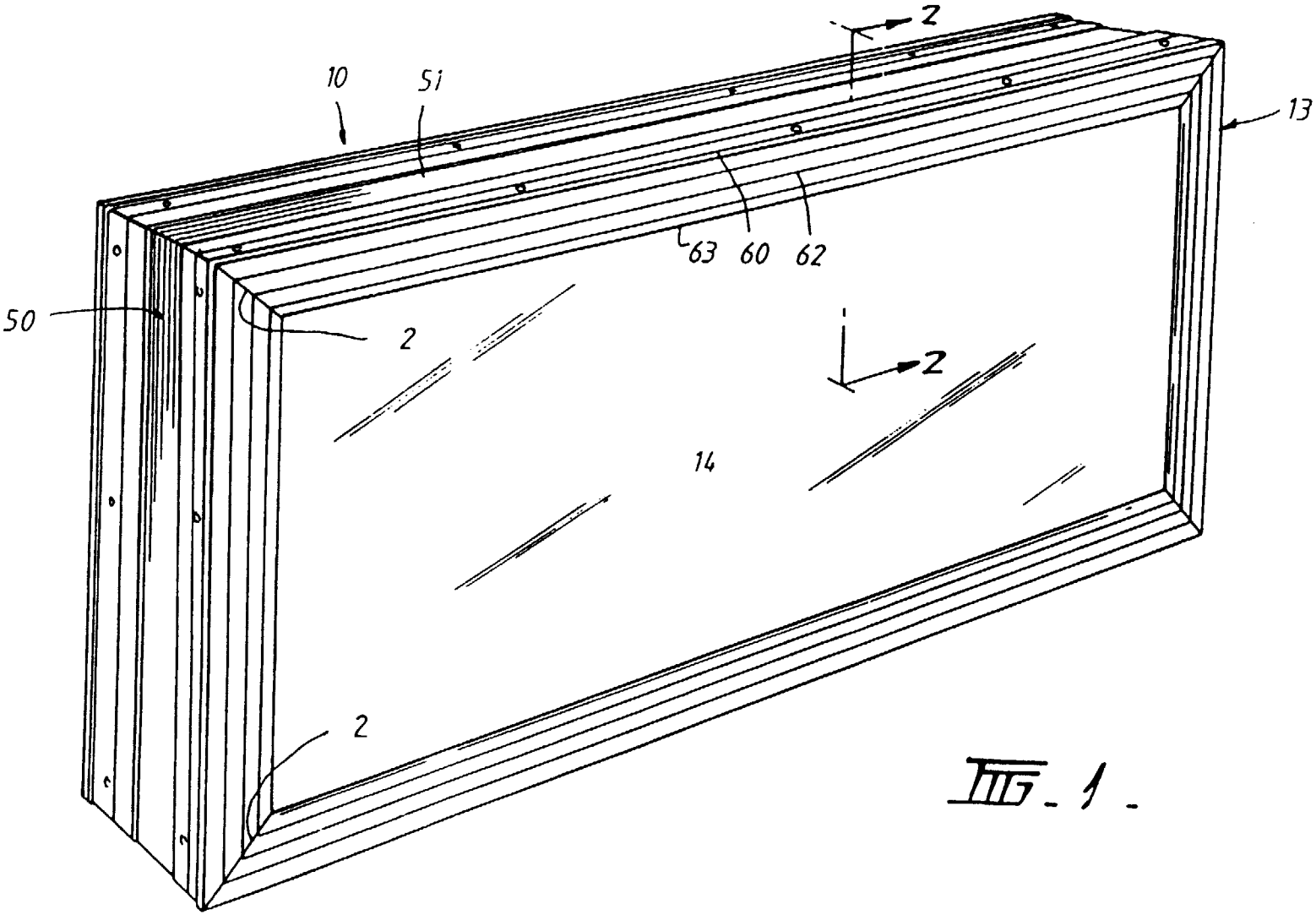
FIG. 1 is a perspective view of a sign made in accordance with the invention.

Referring firstly to the embodiment of FIGS. 1 to 4, we have a frame member 10 which is preferably an aluminum extrusion and this is associated with a channel track 11 and a tension adjustment means 12.

The frame is basically purpose designed and includes a downward extension 20 which is adapted to fit into the channel 30 of the channel track and which has a continuous face 21 against which the channel track abuts.

The frame has a recessed upper portion 22 which, as will be described is adapted to receive a trim cover 13 and has an inwardly directed fork or the like 23 which can be associated with a box member, again, which will be described further hereinafter.

It is also provided with a longitudinal recess 24 which is adapted to receive studs or the like which will be described hereinafter.

It also has a longitudinal recess 25 which is adapted to receive an extension 42 of the tension adjustment means 12.

The channel track member 11 has a longitudinal, substantially circular, recess 31 which is open along its inner edge 32 and is adapted to co-operate with the edge of the sign face 14.

As illustrated, this edge includes a cylindrical member 80 which, in a preferred embodiment may be a rope, which is surrounded by the face material 14 which can be sewn or welded at 52.

The channel track 11 also has a face 33 which abuts the face 21 of the frame, as previously described, and has a returned member 34 which is adapted to engage with a recess 43 in the tension adjustment member 12.

Each tension adjustment member 12 comprises three components, a block 40, arm 41 and a screw or bolt 44 which is threaded into a tapped aperture 45 in the block 40.

Thus, by rotation of the screw 44, so the relative position of the block 40 and the arm 41 can be varied and, as will be described this effects the tensioning of the sign.

Figure 2:
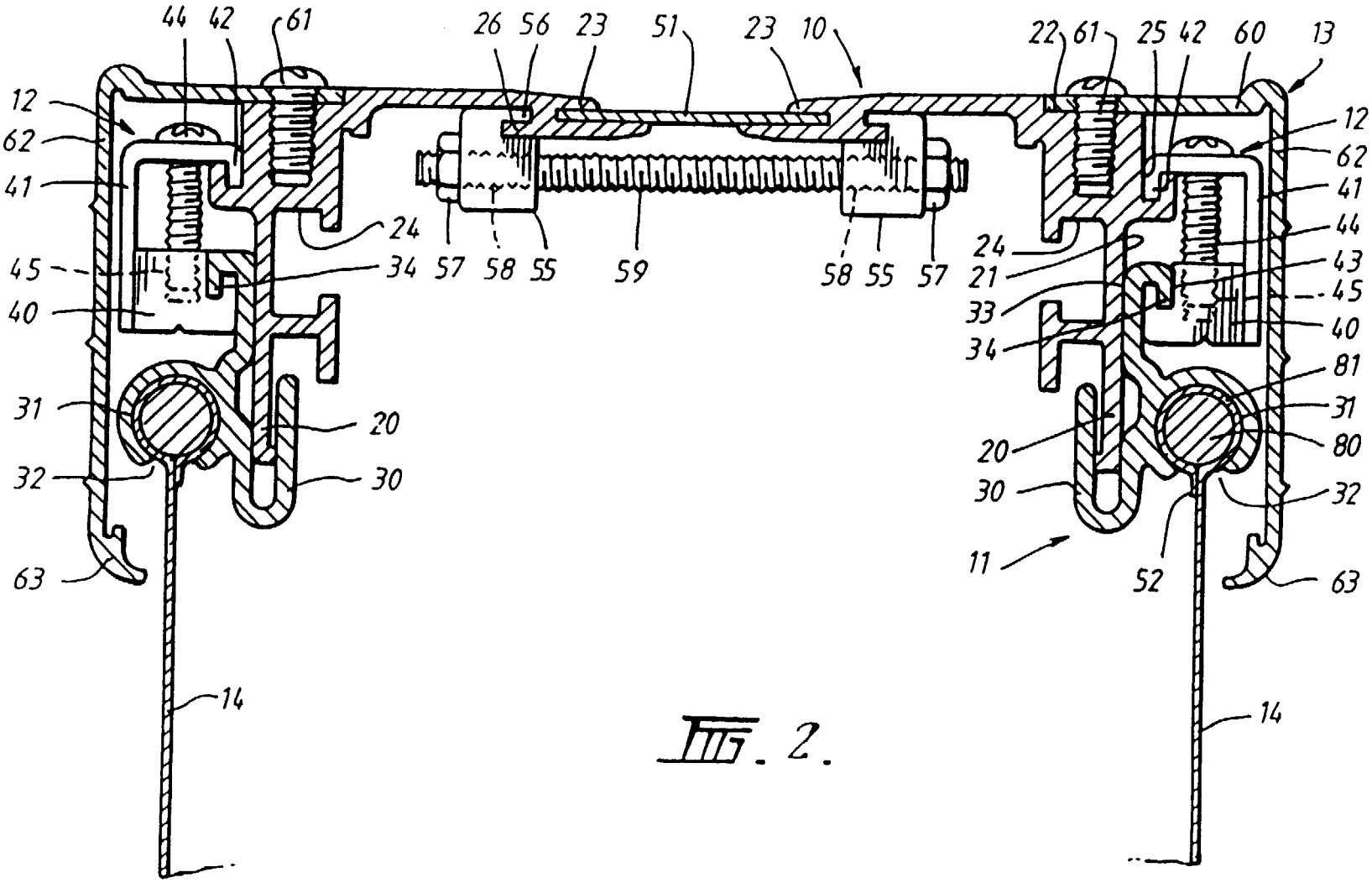
FIG. 2 is a section along line 2—2 of FIG. 1 which shows a double faced sign.
Figure 3:
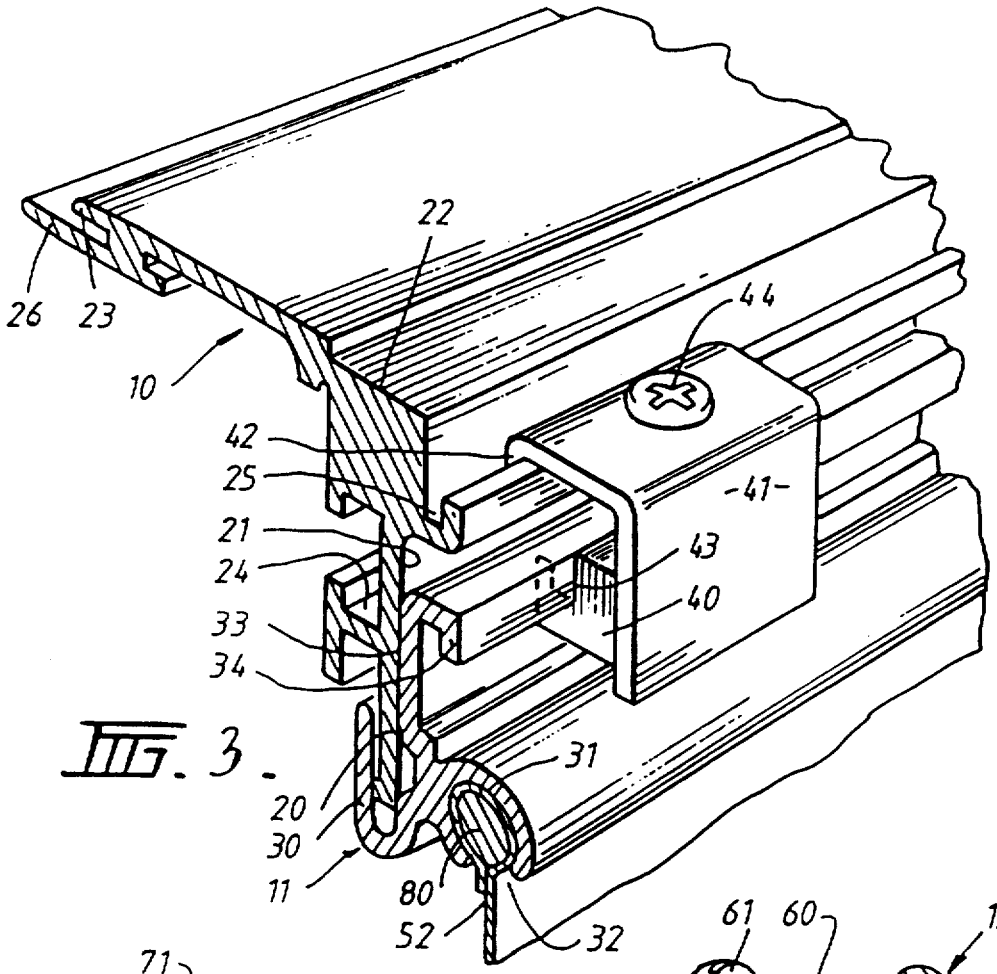
FIG. 3 is a partial perspective showing the location of the sign face and the operation of a tensioning member.

In order to make the inter-reaction of the components clear, we shall describe a first form of sign in relation to FIGS. 1 to 3 of the drawings.

The sign can be considered to be a double sided cabinet and has a peripheral frame 50 which is rectangular in form, the upper member 51 of which is shown in FIG. 2.

It will be appreciated that the frame 50 may be of any required width and may be made of any required material although, practically, it would be made of sheet metal and this could be braced, if necessary, depending upon the size of the frame.

Frame members 10 are formed with mitred edges so that their recesses 23 are adapted to be located over one edge of the peripheral frame 50.

As illustrated in FIG. 2, the attachment between the cabinet member 50 and the frame members 10 can be by means of locking members 55 which have an arm and recess 56 which is complementary to an equivalent arm and recess 26 on the frame member.

A locking bolt 59 can pass through apertures 58 in the members 55 and nuts 57 can be tightened to complete the assembly.

It will be appreciated that, depending upon the size of the cabinet to be made, so the number of such locking assemblies can be varied. The required sign face or faces 14 are formed with a rope 80 located about the peripheral edge thereof, with the rope being retained in the sign face by means of hemming or welding at 81.

This hemming or welding can be effected before or after the face has been prepared, and it is in this aspect that the sign of the invention has a substantial advantage over previous flex face signs, this is that the sign, when assembled does not suffer from distortion.

With most previous flex face signs, it has been necessary, particularly for peripheral material in the sign, to incorporate this after the sign has been located and tensioned.

The channel tracks are then located over the edges of the sign, by relatively longitudinal movement between the track and its adjacent edge, and the channels 30 can be located over the arms 20 of the frame and the tension adjustment members 12, in a released position, can be clipped between the returned portion 34 of the channel track and the recess 25 of the frame member by means of the recess 43 and the return 42 respectively.

By selective location of these tension members and by tightening these, the face of the sign can be both tensioned and can be located in the required position relative to the frame.

This will permit fully accurate location and accurate tensioning and, should there be any need to adjust the tensioning, this can be done simply done by unscrewing the screws 44 and shifting the tension adjustment members or, if required, by locating further tension adjustment members.

This adjustment, it will be seen, is simple as ready access can be obtained to the heads of the screws 44.

When the face is in the required position of tension, it is only necessary to complete the sign by locating a trim cover 13 thereover, one arm 60 of the trim cover being adapted to overlie the recess 22 in the frame and be connected thereto by screws 61 or the like, and the other arm 62 of the trim cover extends over the front of the locating and adjustment mechanism and has an inturned end 63 which terminates close to the sign face.

On completion of location of the trim cover, the sign is completed. It will be seen that, should maintenance work be necessary on the sign of the invention, it is only necessary, initially, to remove the screws 61 which will permit the trim cover to be removed and this gives access to the retaining system.

For example, if it is required to gain access to the interior of the cabinet, it would only be necessary to release the screws 44 and the whole sign face can be taken from the cabinet.

When the maintenance work required, which could be the replacing of electric globes or the like is completed, then the tensioning members 12 are simply replaced, the sign is retensioned and the trim cover replaced.

In previously flexible faced signs, it has not been possible to effect such an operation with any reliability and, indeed, where access to the signs has been required, it is normally necessary to provide inspection openings in the cabinet or a pivotted side or face so as to not disturb the face.

Also, if it is required to replace a flexible face, either simply to provide a different sign or because of damage or the like, it is only necessary to remove the trim covers, release the tension on the sign, remove the sign face, relocate the channel tracks on the new sign, which can be fully prepared, and relocate the tension members, tension these correctly and then replace the trim cover.

This operation can quickly and readily be done by one or two workmen, depending upon the size of the sign, and the result is completely satisfactory.

Figure 4:
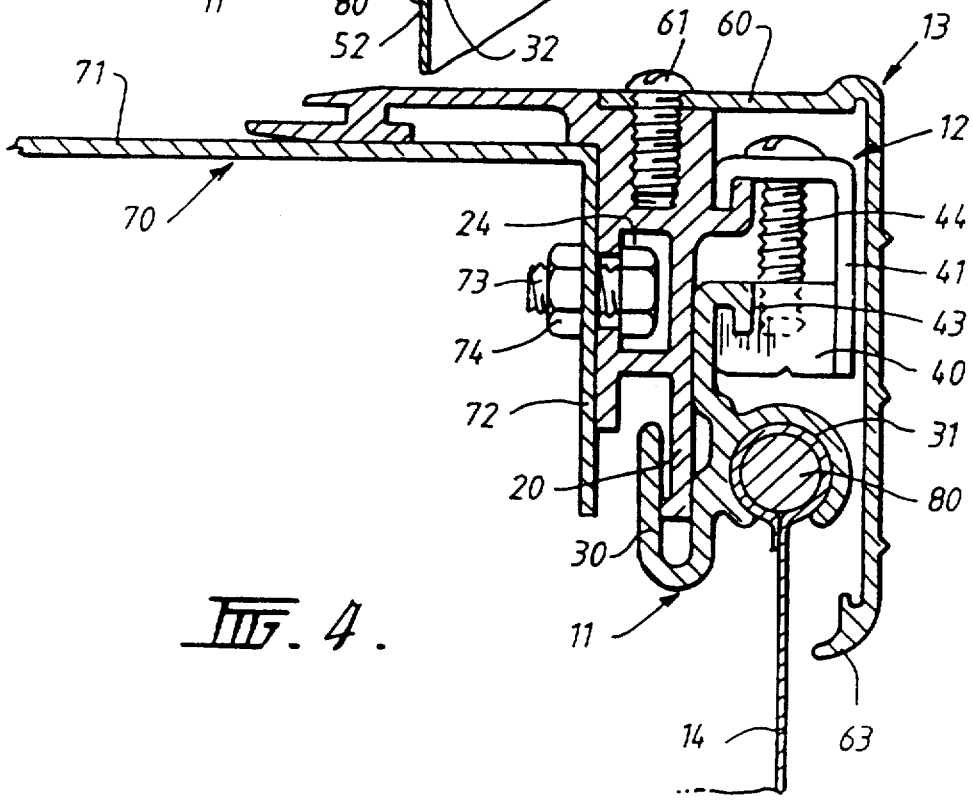
FIG. 4 is a section similar to FIG. 3 showing the interconnection of the extrusions of FIG. 3.

Referring to the arrangement of FIG. 4, the assembly is effectively identical to that of the earlier embodiment but, instead of having a cabinet, there is a sign box or body 70, of which one surface 71 is illustrated, and this has an internally directed flange 72. This could be a standard sign box or body.

The arrangement here is that bolts can be passed along the recess 24 to required positions, the frame members can then be bolted to the flange 72 by the bolt 73 and nuts 74, as illustrated in FIG. 4, so as to form a sign box including the frame members of the invention.

Once this location is completed the channel tracks and tension adjustment means are located in the same manner as the earlier embodiment and the sign is completed by the location of a trim cover.

Figure 5:
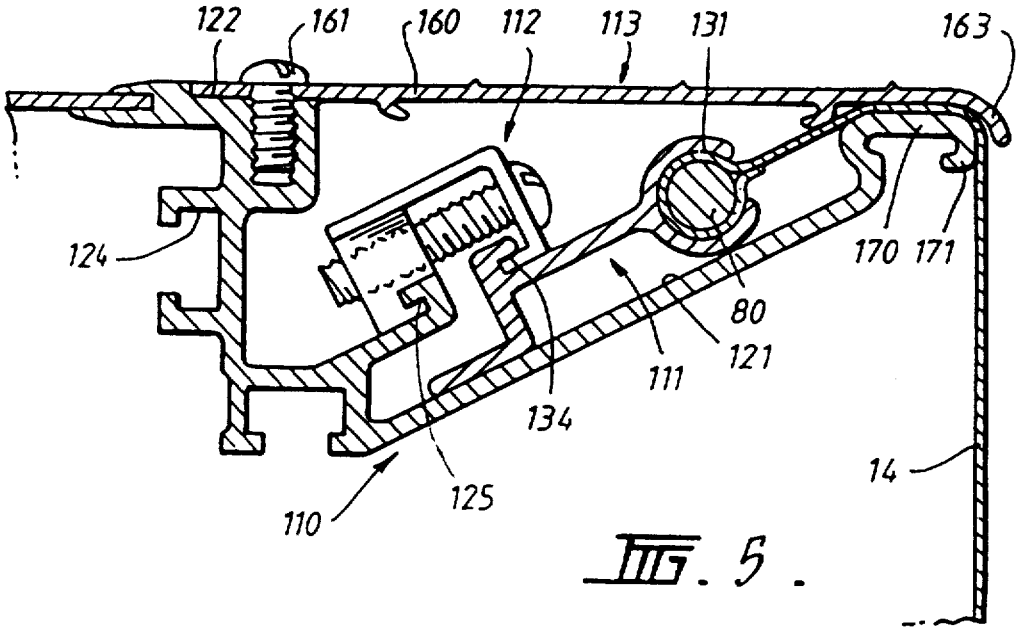
FIG. 5 shows a modified form of sign where the face extends effectively to the periphery of the sign.

The embodiment illustrated in FIG. 5 shows a means of providing a full face sign.

In this case, the frame member 110 is located in a different orientation to the frame member 10 as is the channel track 111 relative to the channel track 11.

The tensioning device 12 can be identical to that of the earlier embodiment.

In this arrangement, instead of the longitudinal receiving member 131 being downwardly directed, this is upwardly and outwardly directed and the channel track 111 lies on a surface 121 which is upwardly and outwardly directed.

The recess 134 of the channel track is parallel to the direction of the surface 121 as is the recess 25 in the frame member.

The arrangement then permits the tension adjustment member 112 to be located between the recesses 125 and 134 so that the channel track 111 can be drawn down the surface 121 of the frame member.

At its outer end, the frame member has an extension 170, which has a curved outer surface 171 and the arrangement is such that the face of the sign 14 passes around the curved outer 171 across the surface 70 and the rope or the like 50 in the sign is located in the recess 131.

It will be seen, functionally, that the tension adjustment member 112 can operate in a completely analagous way to the similar member 12 of the earlier embodiment.

In this case, however, the face of the sign terminates closely adjacent the edge of the surface and the trim cover 113 has a first member 160 which is of substantial length and is located in a recess 122 in the frame by screws of the like 161.

The forward end 163 of the trim cover extends slightly over the edge of the sign and is substantially parallel to the upper portion of the curved surface 171 of the frame 110.

It will be seen that the embodiment of the Figure has each of the features of the previous embodiment in that the sign face can be fully prepared at a factory, it is easy to locate and adjust so work can readily be done by a minimum number of workers and the finished sign is at least equivalent in appearance to any previous sign of the general type.

It also has the feature that the face can readily be removed either for access into the sign body or to enable the face itself to be replaced.

Although not illustrated, it will be seen that the frame 110 is provided with a longitudinal recess 124 which can be identical to the recess 24 of the earlier embodiments and a connection similar to that of FIG. 4 can readily be achieved.

This is most useful where the sign is to be retro fitted to an existing sign body.

Figure 6:
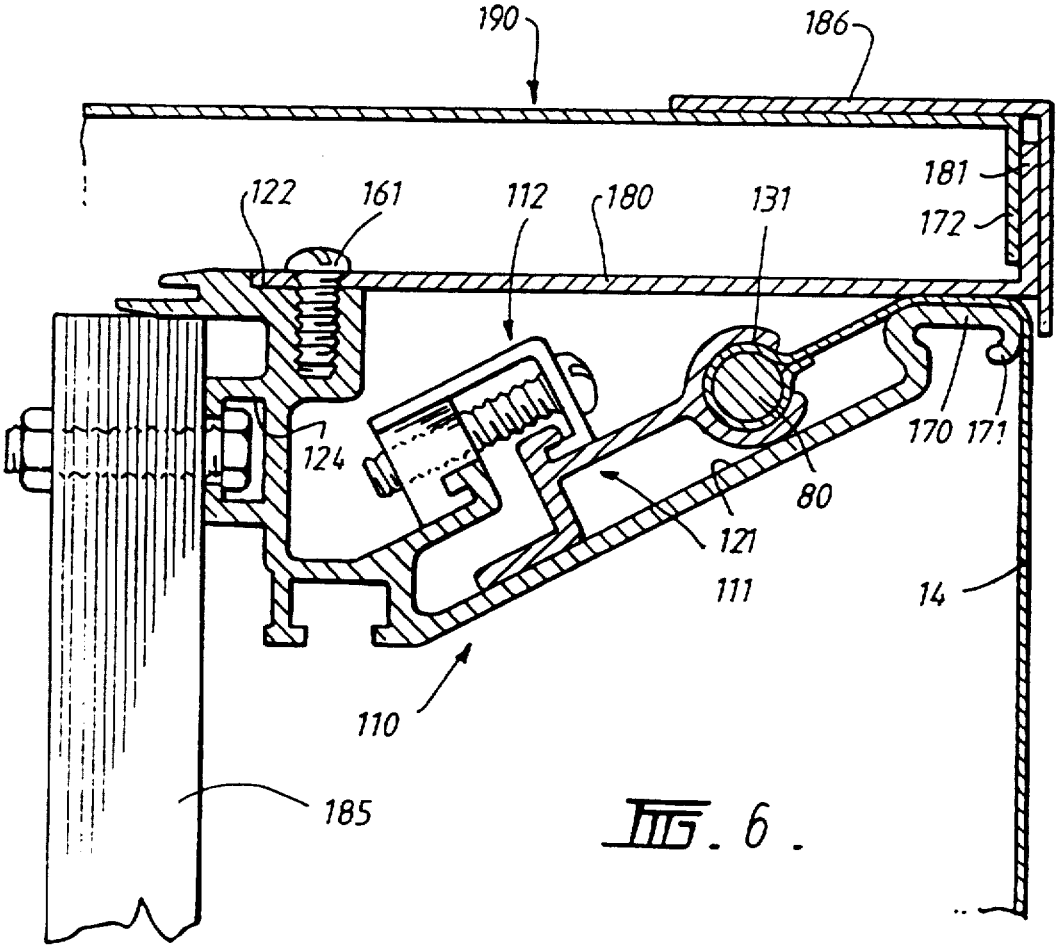
FIG. 6 shows the use of the concept of the invention as a replacement for a normal sign face.

There are application where, either for aesthetic reasons or to meet local Government requirements, there can be no modification to the exterior dimensions of a sign and the embodiment of FIG. 6 is an arrangement whereby an embodiment similar to that of FIG. 5 can be retro fitted within the dimensions of an initial sign box and a flexible face sign of the invention directly replace an acrylic face for which the box was designed.

In this case we provide a bracket 180 which is connected by way of screws 161 to recesses 122, which bracket extents slightly above the extension 170 and has an outward flange 181 which rests against the normal inwardly directed flange 172 of the original sign box 190.

The thickness of the flange 181 is preferably the same as the thickness of the acrylic face.

We may provide tubular members 185 which are connected to the frame members 110, as illustrated, to hold the sub-assembly rigid and the whole sign is simply located within the confines of the original sign box and the trim cover 186 of the original sign box can be located thereover and these retain the sign in position.

Whilst, in the illustrated embodiments of the invention, we have shown the sign as being rectangular, it will be appreciated that other shapes are also readily possible.

It is even feasible to manufacture a sign having curved edges, provided the extrusion which can receive the rope or the like is curved.

This could be done by making a plastics extrusion of a relatively hard plastic, but which can, nevertheless, be deformed and, possibly affixing this to another extrusion, possibly in short length, so as to give the necessary overall rigidity.

Also, in the embodiments we have shown the use of a circular member, stated to be a rope, sewn into the edges of the sign.

Practically, this is the simplest way of providing the extension, and gives very satisfactory results, but there are other possibilities available. For example, the connection of the edge of the sign material could be by welding or adhesion and the rope could be replaced by some other member, possibly a plastics extrusion and, if this is done, the extrusion could have a shape other than circular and, provided it can be located within the extension on the channel track, it will work efficiently.

It may be preferred that the extension on the channel track be made complementary to the member.

It is also possible to provide a separate member, as by extrusion, which has a tail or the like and then to connect this tail to the edge of the sign material and the connection may be by sewing, welding or adhesion.

In a still further form, the connection could be by turning the edge of the fabric of the sign face over an extension member and then, by clips or the like, connecting the fabric to the extension member.

The sign of the present invention has a number of advantages over previous signs of the flexible face type.

The first is that the sign can be prepared quite independently of the frame and thus there is no need even to form the frame when the sign faces are being made.

Secondly, the face so formed can readily be rolled and this means that a full sign can be sent on site with the various components cut to size, the box assembled on site, the sign face located, and tension achieved, with the knowledge that the finished sign face will be correctly located relative to the frame.

A third advantage is, where the sign face is to be replaced, either because of damage or because of a required changed image, then the new faces can simply be prepared in the workshop, knowing the dimensions of the sign, the sign face can be rolled and delivered to the site, where it can be unrolled and placed on the frame with confidence that correct tensioning can be achieved.

I claim:

1. A sign of the flexible face type wherein, at or adjacent an edge of a material of the sign, there is provided a continuous extension, complementary means located about a periphery of the sign face and adapted to receive this extension and means whereby this complementary means can be moved relative to the sign face to thereby apply tension to the material, wherein the sign has a peripheral frame member with plural sides, the complementary means comprising a channel track adapted to be located adjacent the frame member and to be moved relatively thereto, further having a sign box having inwardly directed peripheral edges, the plural sides associated therewith having means whereby they can be affixed thereto, wherein affixed to or associated with each frame member is a bracket which has an outwardly directed flange adapted to abut the outer surface of the adjacent peripheral edge of the sign box whereby the frame members of the sign can be located within the sign box with the flexible face extending across the front face thereof.

2. A sign as claimed in claim 1 wherein the sign has about its periphery a member sewn into a pocket formed from the sign material and this is adapted to co-operate with an open sided extrusion of the complementary means or the like of substantially complementary shape wherein the edge of the sign is restrained.

3. A sign as claimed in claim 1 wherein an extension member is connected to the edge of the sign face by sewing, welding or adhesive.

4. A sign as claimed in claim 1 wherein there is at least one tension adjustment member adapted to be located between the frame member and the channel track and which can effect relative movement between these, to thereby vary the tension of the sign face.

5. A sign as claimed in claim 4 wherein the tension adjustment member engages with a spaced extension on each of the frame members and the channel track and can move these together.

6. A sign as claimed in claim 1 wherein a trim member is connected to the frame member and extends over the components and terminates adjacent the face of the sign.

* * * * *